US005499752A

United States Patent [19]

Johnson

[11] Patent Number: 5,499,752

[45] Date of Patent: Mar. 19, 1996

[54] SHOULDER BOW CARRIER

[76] Inventor: David A. Johnson, P.O. Box 12204, Salem, Oreg. 97309

[21] Appl. No.: 77,911

[22] Filed: Jun. 21, 1993

[51] Int. Cl.[6] ..... A45F 3/14

[52] U.S. Cl. ..... 224/258; 224/916; 224/917; 224/202; 124/88

[58] Field of Search ..... 224/916, 917, 224/202, 257, 258; 124/88

[56] References Cited

U.S. PATENT DOCUMENTS

| | | | |
|---|---|---|---|
| 3,960,302 | 6/1976 | Mazzoni, Jr. | 224/257 X |
| 4,103,807 | 8/1978 | Lyon et al. | 224/916 X |
| 4,480,774 | 11/1984 | Smith et al. | 224/916 X |
| 4,724,989 | 2/1988 | Silberberg | 224/202 |
| 4,768,689 | 9/1988 | Davis | 224/257 |
| 4,804,025 | 2/1989 | Bear | 224/202 |
| 5,038,987 | 8/1991 | Huddleston | 224/258 |
| 5,065,732 | 11/1991 | Smith | 124/88 |
| 5,239,976 | 8/1993 | Specht | 124/88 |

*Primary Examiner*—Ernest G. Cusick
*Attorney, Agent, or Firm*—Charles N. Hilke

[57] ABSTRACT

A shoulder bow carrier comprising an adjustable shoulder strap made of flexible material, having loops at each end of the shoulder strap for receiving and supporting the ends of a bow and joining the ends of the shoulder strap by a flexible, stretchable piece of material which is within a fixed-length flexible tube assembly.

6 Claims, 3 Drawing Sheets

SHOULDER BOW CARRIER

BACKGROUND OF THE INVENTION

1. Field of the Invention

This invention relates to a means for carrying a bow, and, more particularly, a shoulder bow carrier.

2. Prior Art

While hunting or target practicing, the bow must be carried. This can be done by carrying the bow by hand which may become tiresome over a period of time. In addition, when hunting, freedom of movement for both hands is sometimes necessary when traversing undergrowth, or making animal calls or spotting animals with binoculars.

Shoulder straps with clips or other mechanical means have been used. While this may be adequate for target shooting, the noise and amount of time required to loosen the bow are unacceptable.

U.S. Pat. No. 4,103,807 discloses a compound bow holster which nestles and supports one end of the bow. However, the design of the invention requires one hand to support the bow. U.S. Pat. No. 4,754,904 discloses a means carrying a compound bow or firearm. Quick release means are not provided. U.S. Pat. No. 3,998,367 discloses an adjustable shoulder harness where adjustment is by the usual means of adjustable buckle. U.S. Pat. No. 4,768,689 discloses a flexible sling apparatus which requires a turning motion to release the bow. U.S. Pat. No. 4,760,944 uses fabric mounting members using velcro to mount a sling assembly. The sling in U.S. Pat. No. 5,065,732 is used for carrying and steadying the bow during aiming and firing of an arrow. Similarly U.S. Pat. No. 5,038,987 is also used for carrying and during shooting of an arrow.

What is needed is a bow carrier which frees the hands and allows quick, quiet and efficient means to have the bow ready for shooting.

SUMMARY OF THE INVENTION

A shoulder bow carrier comprising an adjustable shoulder strap for comfortably carrying a bow regardless of the archer's size. At each end of the shoulder strap a flexible loop is fixed for loosely receiving the ends of a bow. The ends of the shoulder strap are joined together by a flexible, stretchable piece of material which is enclosed within a fixed-length flexible tube assembly.

It is an object of this invention to provide a simple, inexpensive shoulder bow carrier.

It is another object to provide a noiseless shoulder bow carrier when engaging or disengaging a bow.

It is another object to provide an efficiently operable bow carrier.

It is another object to provide a bow carrier which does not hang from cables or string but is positively retained to the bow.

It is a final object to provide a single bow carrier which is adjustable for any size archer and any size bow.

DESCRIPTION OF THE DRAWINGS

In the drawings accompanying the specification and forming a part of this application, there is shown, for purpose of illustration, an embodiment my invention may assume.

DESCRIPTION OF THE PREFERRED EMBODIMENT

Figure 1:
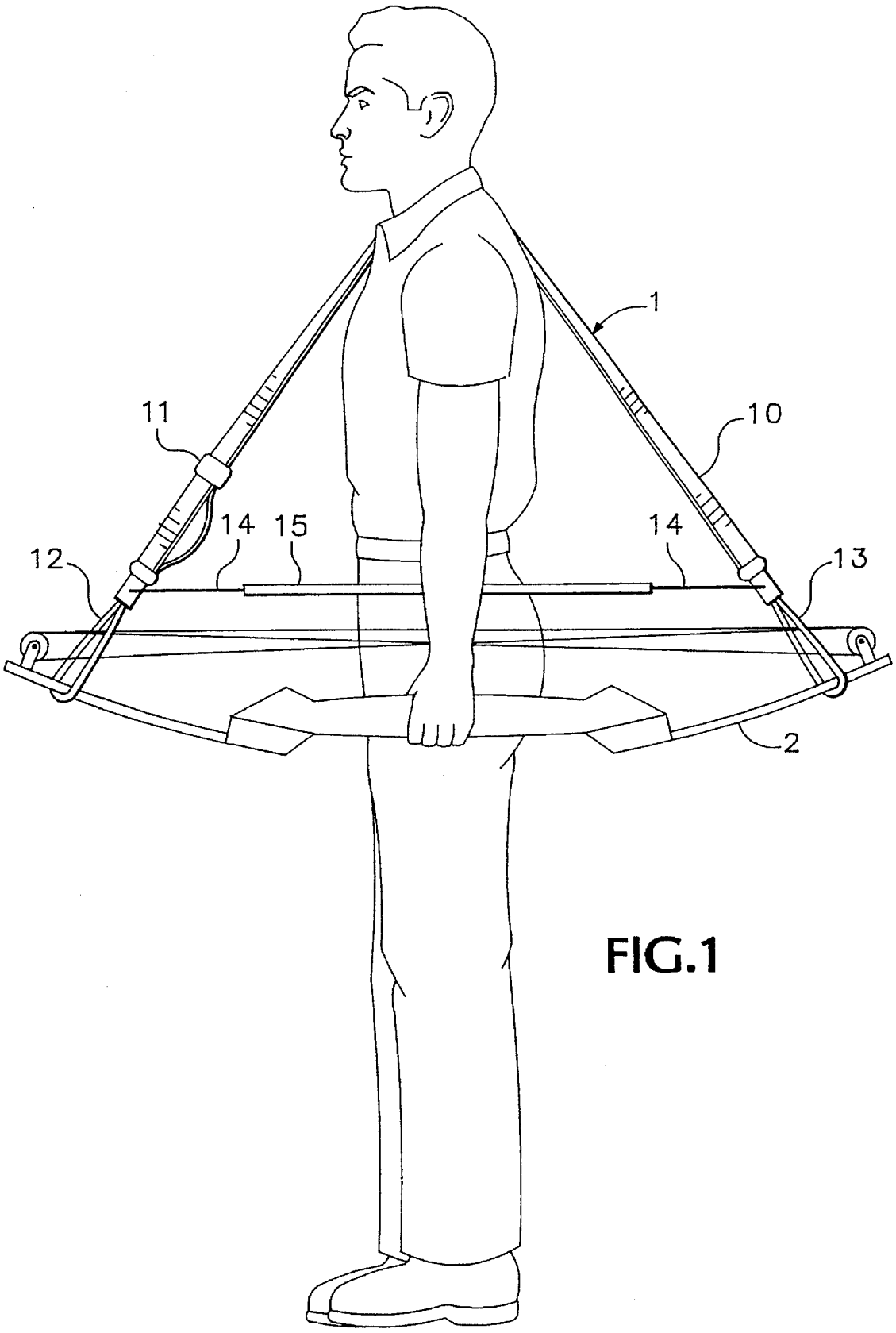
FIG. 1 is a side elevational view of an archer with the invention supporting a bow.

FIG. 1 is a side elevational view of an archer with the shoulder bow carrier 1 supporting a bow 2. The shoulder strap 10 generally wraps around the shoulder opposite the side the bow 2 is carried on. An adjustable mechanism 11, several of which are in common use, changes the length of the shoulder strap 10 so that the bow 2 is held in a comfortable position regardless of the size of the archer. The upper loop 12, fixed to one end of the shoulder strap 10, fits loosely around one end of a bow 2. The lower loop 13, fixed to the other end of the shoulder strap 10, fits loosely around the other end of the bow 2. The flexible, stretchable material 14 is shown fixably attached to both ends of the shoulder strap 10.

Figure 2:
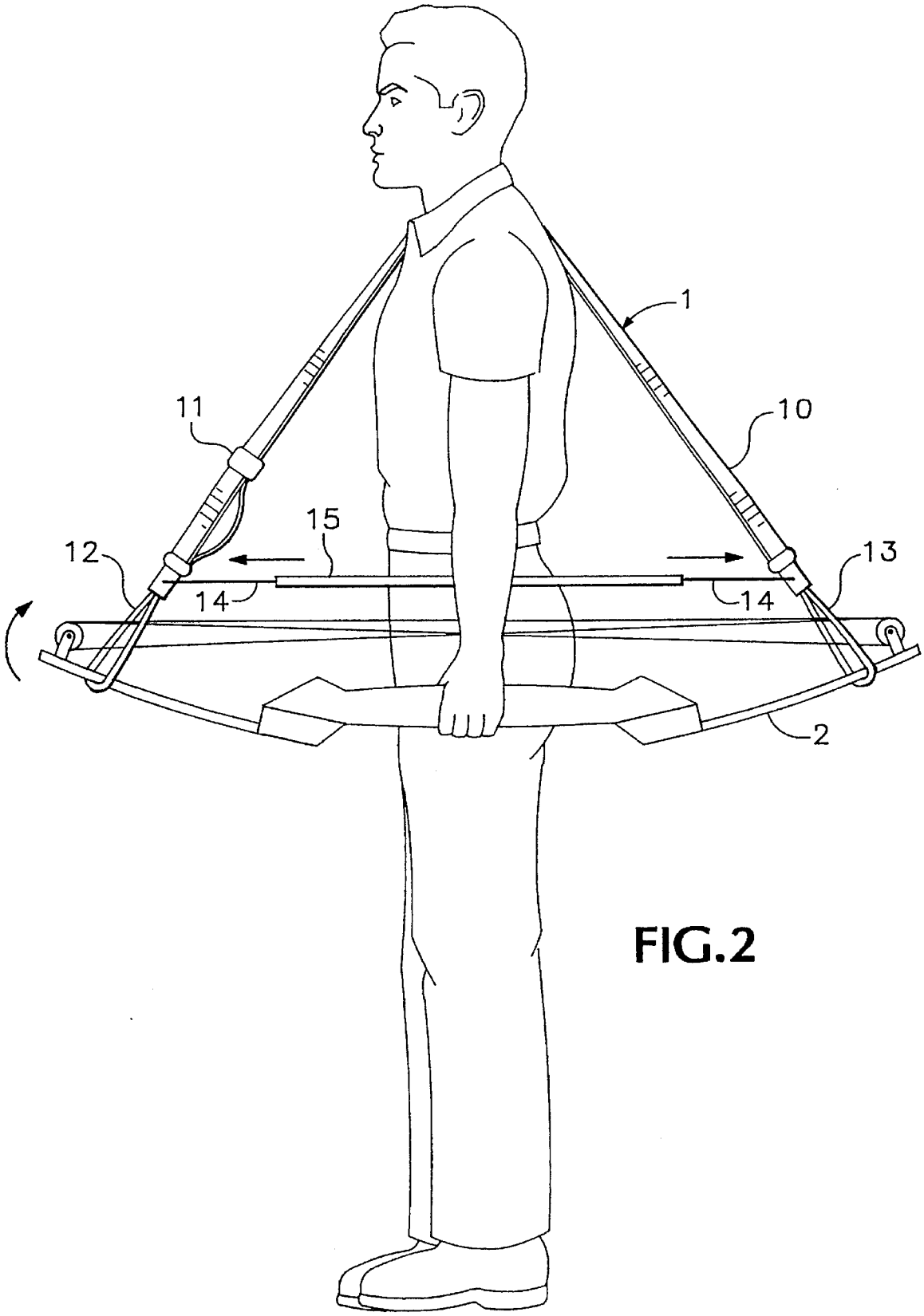
FIG. 2 is a side elevational view showing the archer's motion releasing the bow from the bow carrier.

In FIG. 2 the manner in which the bow 2 is released from the shoulder bow carrier 1 is shown. One hand grasps the bow 2 while the other hand grasps the fixed length tube assembly 15 and slides it along the flexible, stretchable material 14 towards the upper loop 12. Once the tube assembly 15 reaches the end of shoulder strap 10, the material 14 stretches and lengthens so that the upper loop 12 slips off the end of the bow 2. Retain a firm grip on the tube assembly 15, allowing the material 14 to pull the tube assembly 15 down and back to the lower loop 13. Briefly stop when the tube assembly 15 stops. Keeping a firm grip on the tube assembly 15, slightly tip up the bottom end of the bow 2. At the same time push gently back and down on the lower loop 13 with the tube assembly 15. This will free the lower loop 13 from the bow 2. The semi-flexible tube assembly 15 allows enough push to be applied to the lower loop 13 to positively disengage it from the bow 2. The tube assembly 15 will then hang in a curve, conforming to the body.

Figure 3:
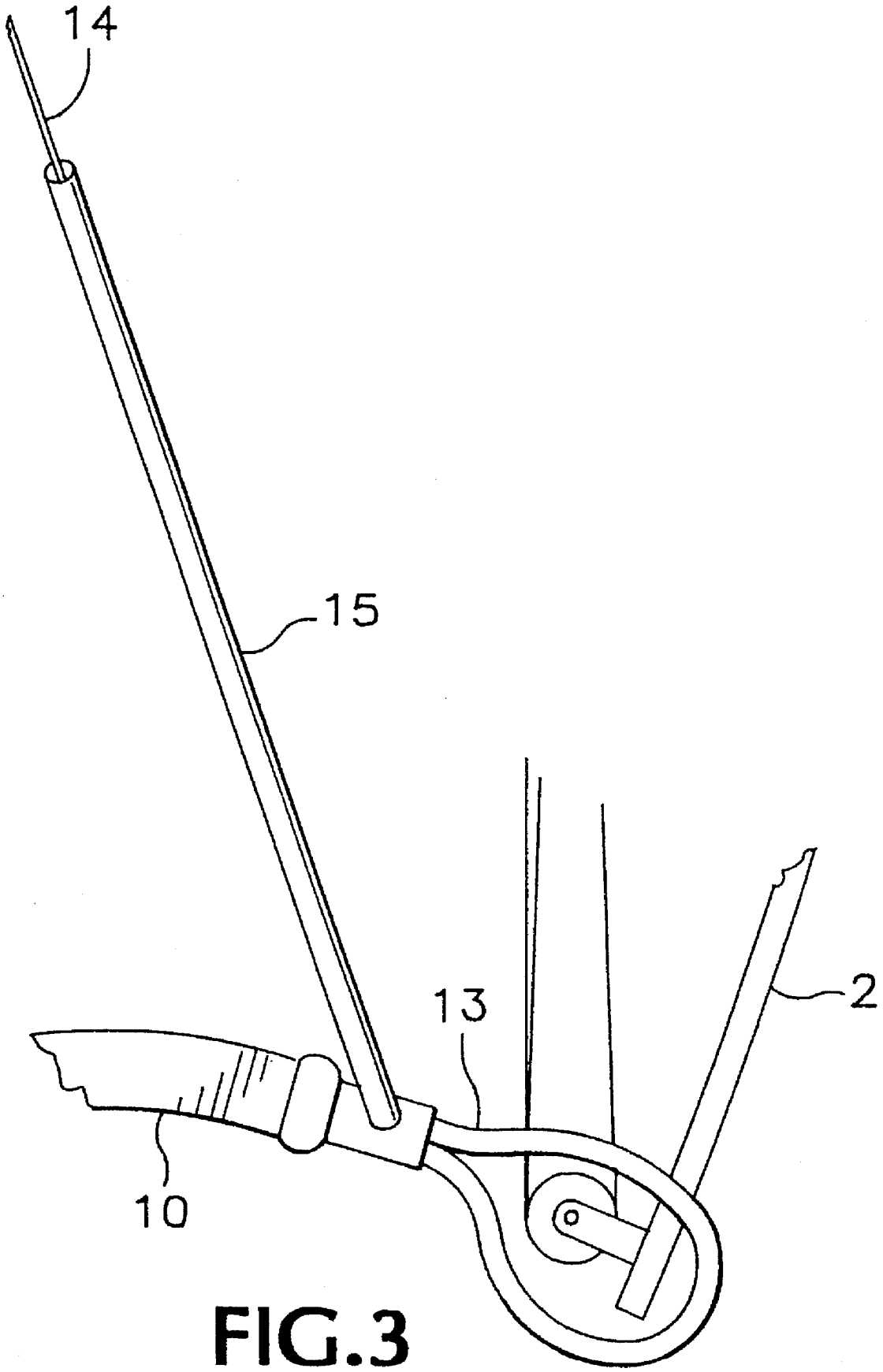
FIG. 3 is a detailed view of a loop, end position of a bow, and a flexible, stretchable piece of material within a fixed-length flexible tube assembly.

FIG. 3 shows the loops 12, 13 are fixably attached to the ends of the shoulder strap 10. Likewise, the flexible, stretchable material 14 is fixably attached to the ends of the shoulder strap 10. However, the tube assembly 15 is not attached to either end of the shoulder strap 10 and is free to slide on the flexible, stretchable material 14. The lower end of the tube assembly 15 is flared which aids in quiet operation.

It is preferred that the fixed length of the tube assembly 15 be less than the length between the ends of the bow 2. It is also preferred that the unstretched length of material 14 be less than the length of the enclosure. Thus the material 14 is under tension when stretched to the length of the tube assembly 15. This tension holds the loops in place around the ends of the bow.

I claim:

1. A shoulder bow carrier comprising:

a) a shoulder bow;

b) a shoulder strap;

c) an upper connecting means on one end of said shoulder strap and a lower connecting means on the other end of said shoulder strap where said means each loosely receive one end of said shoulder bow;

d) a flexible, stretchable piece of material between the ends of said shoulder strap, fixably attached near each end of said shoulder strap which serves to constrain said connecting means to said ends of said bow.

2. The shoulder bow carrier of claim 1 additionally comprising a fixed-length flexible tube assembly within which is said flexible, stretchable material.

3. The shoulder bow carrier of claim 1 where said shoulder strap is adjustable.

4. The shoulder bow carrier of claim 2 where the length of said fixed-length flexible tube assembly is less than the distance between the ends of said bow.

5. The shoulder bow carrier of claim 2 where said flexible, stretchable piece of material is under tension when the length of said material equals the length of said fixed-length flexible tube assembly.

6. The shoulder bow carrier of claim 2 where one end said fixed-length flexible tube assembly is flared.

* * * * *